US011097153B1

(12) United States Patent
Lee

(10) Patent No.: US 11,097,153 B1
(45) Date of Patent: Aug. 24, 2021

(54) ADJUSTABLE BALANCE BOARD

(71) Applicant: Gavin Lee, El Cerrito, CA (US)

(72) Inventor: Gavin Lee, El Cerrito, CA (US)

( * ) Notice: Subject to any disclaimer, the term of this patent is extended or adjusted under 35 U.S.C. 154(b) by 0 days.

(21) Appl. No.: 16/445,122

(22) Filed: Jun. 18, 2019

Related U.S. Application Data

(60) Provisional application No. 62/689,010, filed on Jun. 22, 2018.

(51) Int. Cl.
*A63B 22/18* (2006.01)

(52) U.S. Cl.
CPC ..... *A63B 22/18* (2013.01)

(58) Field of Classification Search
CPC ..... A63B 2071/0072; A63B 22/14–16; A63B 22/18; A63B 22/20; A63B 26/003; A63B 21/023; A63B 21/153
See application file for complete search history.

(56) References Cited

U.S. PATENT DOCUMENTS

| | | | | |
|---|---|---|---|---|
| 2,256,001 | A | 9/1941 | Titus | |
| 3,352,559 | A | 11/1967 | Larsen | |
| 3,488,049 | A | 1/1970 | Sasser, Jr. | |
| 3,604,726 | A | 9/1971 | Tracy | |
| 3,730,521 | A | 5/1973 | Sellman | |
| 3,806,116 | A | 4/1974 | Malmberg | |
| 3,984,100 | A | 10/1976 | Firster | |
| 4,026,279 | A | 5/1977 | Simjian | |
| 4,252,312 | A | 2/1981 | Dehan | |
| 4,291,873 | A | 9/1981 | Lee | |
| 4,391,441 | A | 7/1983 | Simjian | |
| 4,491,318 | A | 1/1985 | Francke | |
| 4,787,630 | A | 11/1988 | Watson | |
| 5,203,279 | A | 4/1993 | Eversdyk | |
| 5,292,296 | A | 3/1994 | Davignon | |
| 5,320,594 | A | 6/1994 | Huang | |
| 5,590,930 | A | 1/1997 | Glockl | |
| 5,603,334 | A | 2/1997 | Sharp | |
| 5,683,337 | A | 11/1997 | Zetocha | |
| 5,728,049 | A | 3/1998 | Alberts | |
| 5,810,703 | A | 9/1998 | Stack | |
| 6,019,712 | A | 2/2000 | Duncan | |
| 6,413,197 | B2 | 7/2002 | McKechnie | |
| 6,461,285 | B1 | 10/2002 | Theunissen | |
| 6,602,172 | B1 | 8/2003 | Aigner | |
| 6,695,755 | B1 | 2/2004 | Huang | |
| 6,723,030 | B1 | 4/2004 | Chen | |
| D505,460 | S | 5/2005 | Dalebout | |
| 7,008,359 | B2 | 3/2006 | Fan | |
| 7,094,183 | B2 | 8/2006 | Hsieh | |
| 7,112,168 | B2 * | 9/2006 | Dalebout | A63B 22/18 482/146 |
| 7,175,577 | B2 | 2/2007 | Greenspan | |
| 7,288,055 | B2 | 10/2007 | Blaum | |
| 7,591,774 | B1 | 9/2009 | Tien | |

(Continued)

*Primary Examiner* — Loan B Jimenez
*Assistant Examiner* — Catrina A Letterman
(74) *Attorney, Agent, or Firm* — Steven R. Vosen

(57) ABSTRACT

An exercise device that allows users to exercise in a manner that strengthens their core and improve their balance with respect to rotation. The device includes a base for placing on the ground and a board on which the user stands and a mechanism for adjusting a restoring force to a neutral position. The device may also include a mechanism for limiting the range of rotational motion of the board.

11 Claims, 12 Drawing Sheets

(56) References Cited

U.S. PATENT DOCUMENTS 7,601,107 B2 10/2009 Malov
7,670,265 B1 3/2010 Forrest
7,775,952 B1 * 8/2010 Curran ..... A63B 26/003 482/146
7,993,253 B2 8/2011 Fernandez
8,105,218 B1 1/2012 Vayntraub
8,435,164 B2 5/2013 VanBuren
8,647,239 B1 2/2014 Sokolovas
8,926,483 B1 1/2015 Holloway
8,979,722 B2 3/2015 Klein
9,056,222 B2 6/2015 Thomason
9,327,155 B2 5/2016 Doyle
9,387,363 B1 7/2016 Polinsky
9,393,458 B1 7/2016 Lacaze
9,474,936 B2 10/2016 Weltha
9,776,068 B2 10/2017 Sambeth
9,788,659 B1 * 10/2017 Jen ..... A47C 7/029
9,987,518 B1 6/2018 Stack
10,010,758 B2 7/2018 Osler
10,561,895 B1 2/2020 Lee
2002/0077231 A1 6/2002 Dalebout
2003/0125173 A1 7/2003 Fan
2003/0181300 A1 9/2003 Chin
2003/0195096 A1 10/2003 Hecox
2004/0142802 A1 * 7/2004 Greenspan ..... A61H 1/0237 482/146
2004/0256532 A1 12/2004 Liao
2005/0029842 A1 2/2005 Martin
2006/0211553 A1 9/2006 Cantor
2007/0027010 A1 2/2007 Tsai
2007/0111862 A1 5/2007 Lockett
2007/0155603 A1 * 7/2007 Cook ..... A63B 22/18 482/142
2007/0207906 A1 9/2007 Blaum
2007/0298947 A1 12/2007 Eksteen
2008/0039304 A1 2/2008 Mattox
2008/0064578 A1 3/2008 Huang
2008/0207412 A1 8/2008 Lin
2008/0280741 A1 11/2008 Baek
2009/0163337 A1 6/2009 Petrakov
2009/0188410 A1 7/2009 Billich
2009/0215342 A1 8/2009 Sannes et al.
2010/0087301 A1 4/2010 Juncker
2010/0093506 A1 4/2010 Aigner
2010/0285941 A1 11/2010 VanBuren
2010/0289222 A1 11/2010 Chiu
2011/0039669 A1 2/2011 Stewart
2011/0281702 A1 11/2011 Tudico
2012/0225741 A1 9/2012 Antolick
2012/0264579 A1 10/2012 Klein
2013/0053228 A1 2/2013 Winegar
2013/0116100 A1 5/2013 Chen
2013/0296147 A1 11/2013 Cruz
2014/0005018 A1 1/2014 Palmer
2014/0087927 A1 3/2014 Richard
2014/0155236 A1 6/2014 Curry
2014/0162852 A1 * 6/2014 Ho ..... A63B 21/4033 482/127
2014/0162859 A1 * 6/2014 Cheng ..... A63B 21/05 482/142
2014/0256526 A1 9/2014 Henson
2014/0274585 A1 9/2014 Huanq
2015/0011369 A1 1/2015 Peritz
2015/0209612 A1 7/2015 Shen
2015/0238793 A1 8/2015 Kramer
2015/0238798 A1 8/2015 Liu
2016/0059070 A1 3/2016 Tung
2016/0206918 A1 7/2016 Palmer
2017/0079456 A1 3/2017 Heath
2017/0095696 A1 4/2017 Olsen
2017/0231549 A1 8/2017 Kogler
2017/0291069 A1 10/2017 Zakariasen
2017/0304675 A1 * 10/2017 Panes ..... A63B 21/0023
2018/0117384 A1 5/2018 Endelman
2018/0193693 A1 * 7/2018 Youm ..... G01L 5/00

* cited by examiner

ADJUSTABLE BALANCE BOARD

CROSS-REFERENCE TO RELATED APPLICATIONS

This application claims the benefit of U.S. Provisional Application No. 62/689,010, filed Jun. 22, 2018, the contents of which are hereby incorporated by reference in its entirety.

BACKGROUND OF THE INVENTION

Field of the Invention

This invention relates generally to the field of sports and exercise equipment, and in particular to a balance board for improving and developing the balancing ability of an individual.

Discussion of the Background

Many popular sports activities require a well-developed balance to become proficient. For example, sports such as cycling, skiing, snowboarding, skateboarding, kayaking, paddling, boxing, martial arts, and surfing all involve the use of equipment that requires the user to be able to accurately control their position on the equipment. Continuous shifting and adjustment of the user's weight and center of gravity with respect to the equipment at appropriate times is vital to proper use of the equipment and full enjoyment of the sport.

Exercise equipment, usually referred to as a "balance board," allows users to exercise in a manner that requires that they develop their balancing skills. Balance boards typically include a platform that is supported on the ground by a mechanism that permits the platform to rock and swivel or rotate.

While prior art balance boards allow a user to develop their balance, the boards have some features that make them difficult to use. Thus, for example, such boards typically permit a wide range or unlimited movement, including rotation, making it difficult for beginners to use the devices. In addition, the wide range and/or unlimited movement of prior art balance boards do not simulate certain exercises, and thus do not provide useful training. Thus, for example, boxing or kayaking moves cannot be performed on prior art balance boards, since one punch or swing would result in the user spinning around until they stopped themselves from rotating or fell off.

Thus, there is a need in the art for an apparatus that permits users to develop balancing skills, while providing movement over a limited range and/or rotation. Such an apparatus should be simple and inexpensive to construct and should be usable for a wide range of different exercises.

BRIEF SUMMARY OF THE INVENTION

The present invention overcomes the disadvantages of prior art balance boards by providing a balance board that provides an adjustable restoring force when the user rotates their body away from a neutral position. Thus, for example, the inventive balance board may include a base for placing on the ground and a board for supporting a user. Also included is a mechanism that can increase or decrease the restoring force, thus providing the user with the ability to change the dynamics of using the balance board, and a mechanism to limit the amount of rotation of the board relative to the base.

Certain embodiments provide an exercise apparatus for a user comprising: a base for placing on the ground, where the base has a base axis that is perpendicular to the ground; a board including a platform to accept a body part of the user, where the board has a board axis that is perpendicular to the platform, and where the board has a neutral position relative to the base; and a mechanism to provide a user-selected force on the base towards the neutral position. When the board is rotated about the board axis and away from the neutral position, the mechanism imparts a force on the board towards the neutral position.

Certain other embodiments provide an exercise apparatus for a user comprising: a base for placing on the ground, where the base has a base axis that is perpendicular to the ground; a board including a platform to accept a body part of the user, where the board has a board axis that is perpendicular to the platform, and where the board has a neutral position relative to the base, where, when the board is rotated about the board axis and away from the neutral position, the exercise device imparts a force on the board towards the neutral position; and a mechanism to provide a user-selected limit on a maximum rotation of the board away from the neutral position. When the board is rotated about the board axis and away from the neutral position, the mechanism imparts a force on the board towards the neutral position.

Certain embodiments provide an exercise apparatus for a user comprising: a base for placing on the ground, where the base has a base axis that is perpendicular to the ground; a board including a platform to accept a body part of the user, where the board has a board axis that is perpendicular to the platform, and where the board has a neutral position relative to the base; a pivot disposed between the base and the board, where the pivot, the board, and the base cooperate to move the board away from the base when the board is rotated about the board axis and away from the neutral position and to provide a force on the base towards the neutral position; and an assembly connected to the base and the board, where the assembly is user-adjustable to: 1) limit the maximum displacement of the board away from the base when the board is rotated about the board axis, thus limiting the maximum rotation of the board away from the neutral position, and 2) adjust an additional force on the base towards the neutral position. When the board is rotated about the board axis and away from the neutral position, the mechanism imparts a force on the board towards the neutral position.

These features together with the various ancillary provisions and features which will become apparent to those skilled in the art from the following detailed description, are attained by the balance board of the present invention, preferred embodiments thereof being shown with reference to the accompanying drawings, by way of example only, wherein:

Reference symbols are used in the Figures to indicate certain components, aspects or features shown therein, with reference symbols common to more than one Figure indicating like components, aspects or features shown therein.

DETAILED DESCRIPTION OF THE INVENTION

The present invention includes a balance board having a spring mechanism for adjusting the restoring force on the balance board. The spring mechanism allows the user to adjust this force to facilitate training for core strength, balance timing and rhythm in conjunction with body rotation. Specifically, the mechanism allows for an adjustable range of rotation around the x-axis while allowing the freedom of movement in the tipping of the y and z-axis. The balance board contains a central pivot between a platform, on which the user stands, and a base that is placed on the ground. In certain embodiments, the mechanism connects the platform to the base through a central hole in the pivot, allowing for freedom of movement with adjustments to vary the degree of the angular rotation around the x-axis.

Figure 1:
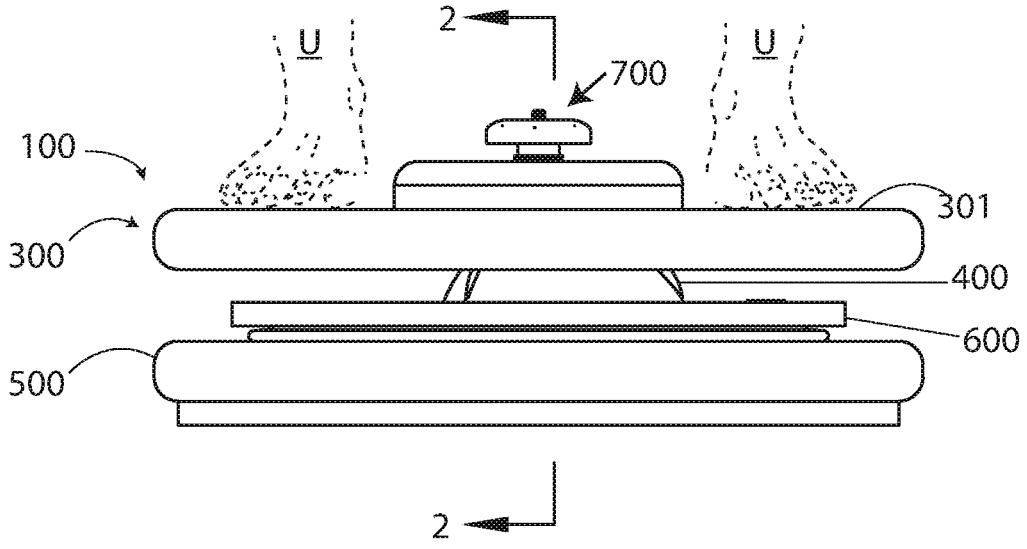
FIG. 1 illustrates a user standing on one embodiment of a balance board with a mechanism to adjust the restoring force.
Figure 4:
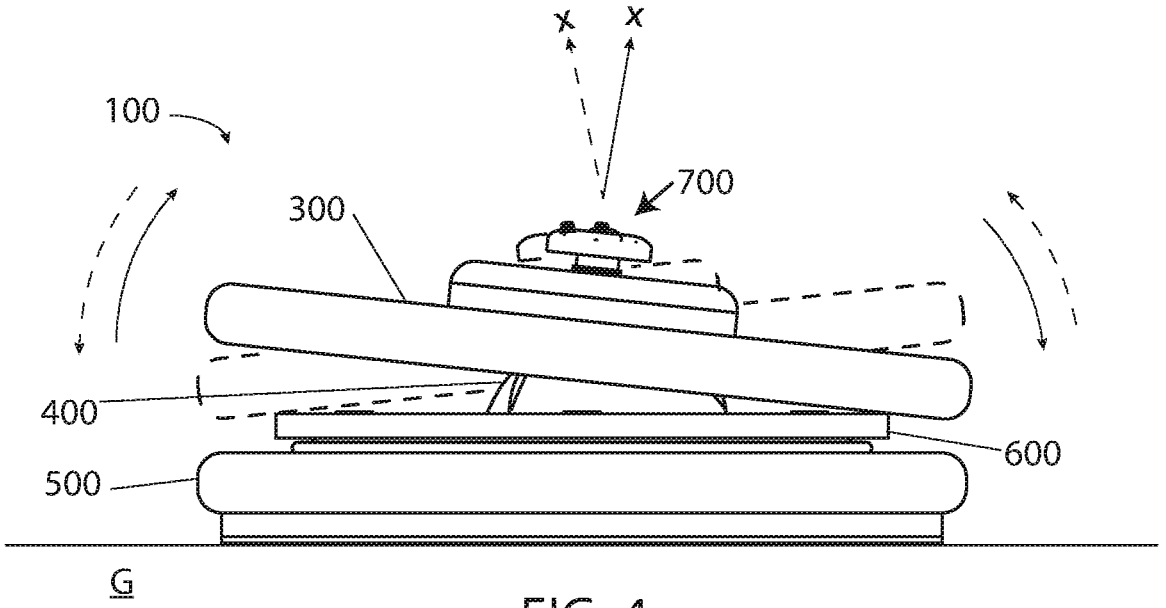
FIG. 4 is a front view of the balance board of FIG. 1.

FIG. 1 illustrates a user, U, standing on one embodiment of a balance board 100. Balance board 100 includes a base 500 for placing on the ground, an optional roller bearing assembly 600 mounted on top of the base, a pivot 400, a platform 300 having a top surface 301 on which user U may stand, and a mechanism 700 connecting the platform and base through an aperture through the pivot. Mechanism 700, which is described in greater detail subsequently, provides an adjustment of the restoring force of the platform to a neutral position relative to base 500. Roller bearing assembly 600 is similar to an assembly used in a lazy Susan, which permits a top and bottom portion to rotate on roller bearings and may be used to prevent the base from interfering with the platform when the platform is tilted, as shown in FIG. 4.

Balance board 100 and its operation are an improvement to the design and function of the balance board described in U.S. patent application Ser. No. 15/470,474 (the '474 application) filed on Mar. 27, 2017 and U.S. patent application Ser. No. 15/480,368 (the '368 application) filed on Apr. 6, 2017, which are both incorporated herein by reference, with the addition of mechanism 700. Thus, for example as described in the '474 application and '368 application, base 500, pivot 400, and platform 300 cooperate to have a neutral position, such that when a user stands on the platform and rotates about an axis normal to the ground, a restoring force (or torque) is provided to urge the platform to return to the neutral position. The restoring force is proportional to the amount of rotation from the neutral position and the force between base 500 and platform 300. In the present invention, the restoring force due to the weight of user U is increased by the adjustable force provided by mechanism 700. Mechanism 700 may also be used to adjust the height that platform 300 may rise above base 500 when the platform rotates and may be used to adjust the amount of rotation of platform relative to the base.

Figure 2:
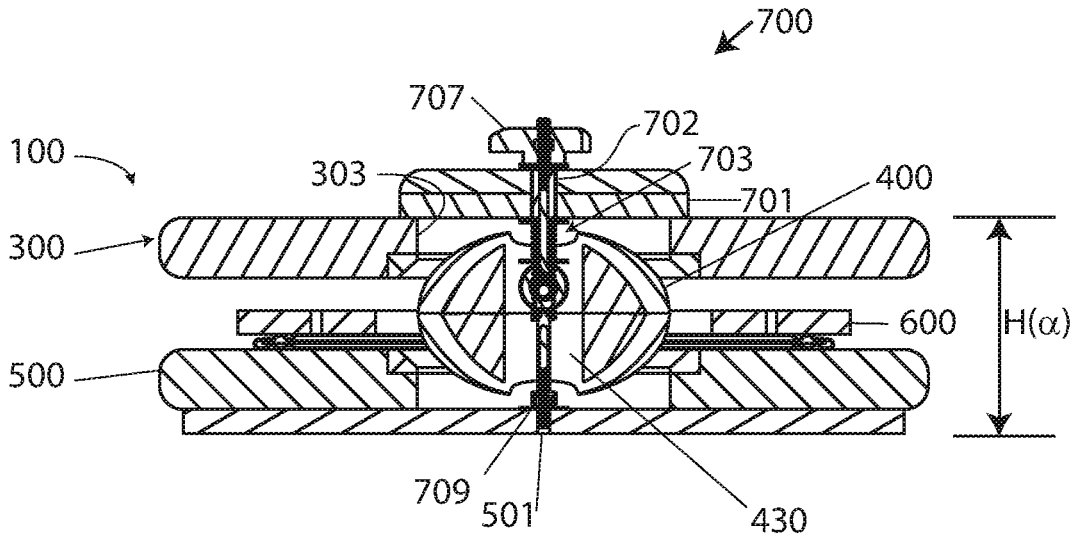
FIG. 2 is a cross-sectional view 2-2 of FIG. 1.

FIG. 2 is a cross-sectional view 2-2 of FIG. 1 which shows that: platform 300 has an aperture 303 and a top portion 701 having an aperture 702; pivot 400 has a central hole 430; and mechanism 700 includes a spring mechanism 703 and a knob 707. Mechanism 700 extends through apertures 702 and 303 and central hole 430 to a spring mechanism bottom end 709 that is attached to a hole 501 in base 500.

When knob 707 is rotated, the length of a spring in mechanism 700 changes, resulting in a change in the tension in spring mechanism 703, which in turn changes a compressive force between platform 300 and base 500 and affects the forces acting on balance board 100.

Figure 3:
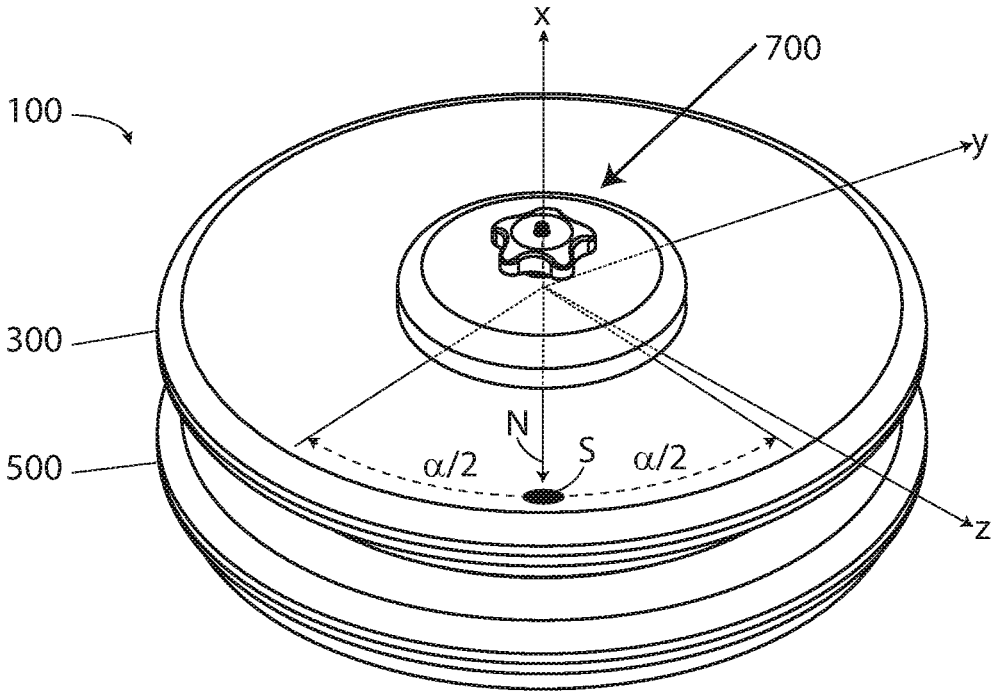
FIG. 3 is a top perspective view of the balance board of FIG. 1.

FIG. 3 is a top perspective view of balance board 100 of FIG. 1, indicating an x axis, and FIG. 4 is a front view of the balance board, showing the angle of tipping in the y and z-axis. In use, base 500 does not move on ground G, while platform 300 moves relative to the base according to the weight and forces applied by user U to the platform, and an additional, adjustable forces provided by mechanism 700, with the x axis extending perpendicularly upwards from the platform. Corresponding axis y and z are perpendicular to, and in the plane of, platform 300. Thus, the x axis is generally in line with the posture of a user U that is standing on platform 300, and the x, y, and z axis move with the user.

Figure 5:
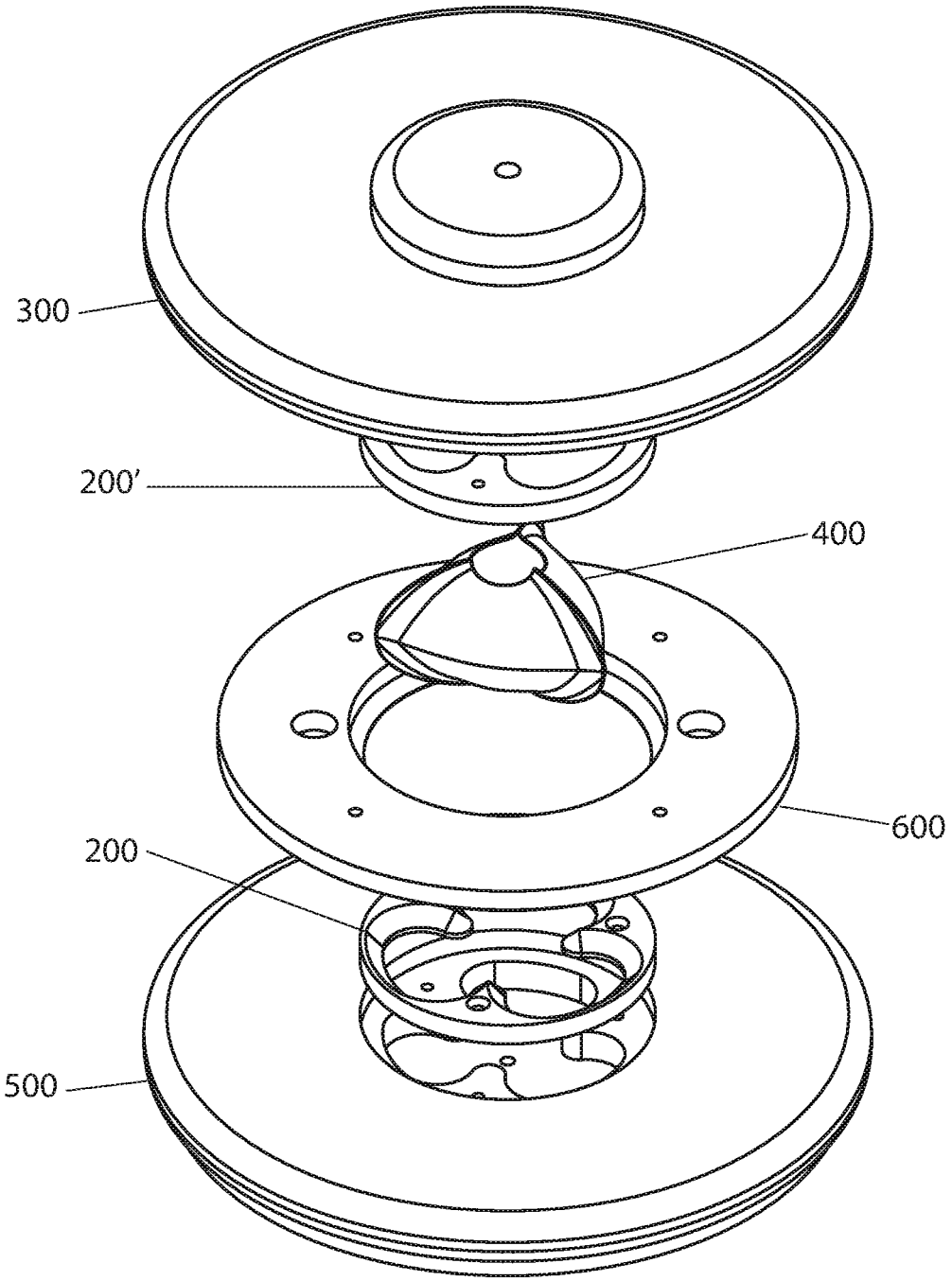
FIG. 5 is an exploded perspective view of the balance board of FIG. 1.
Figure 6:
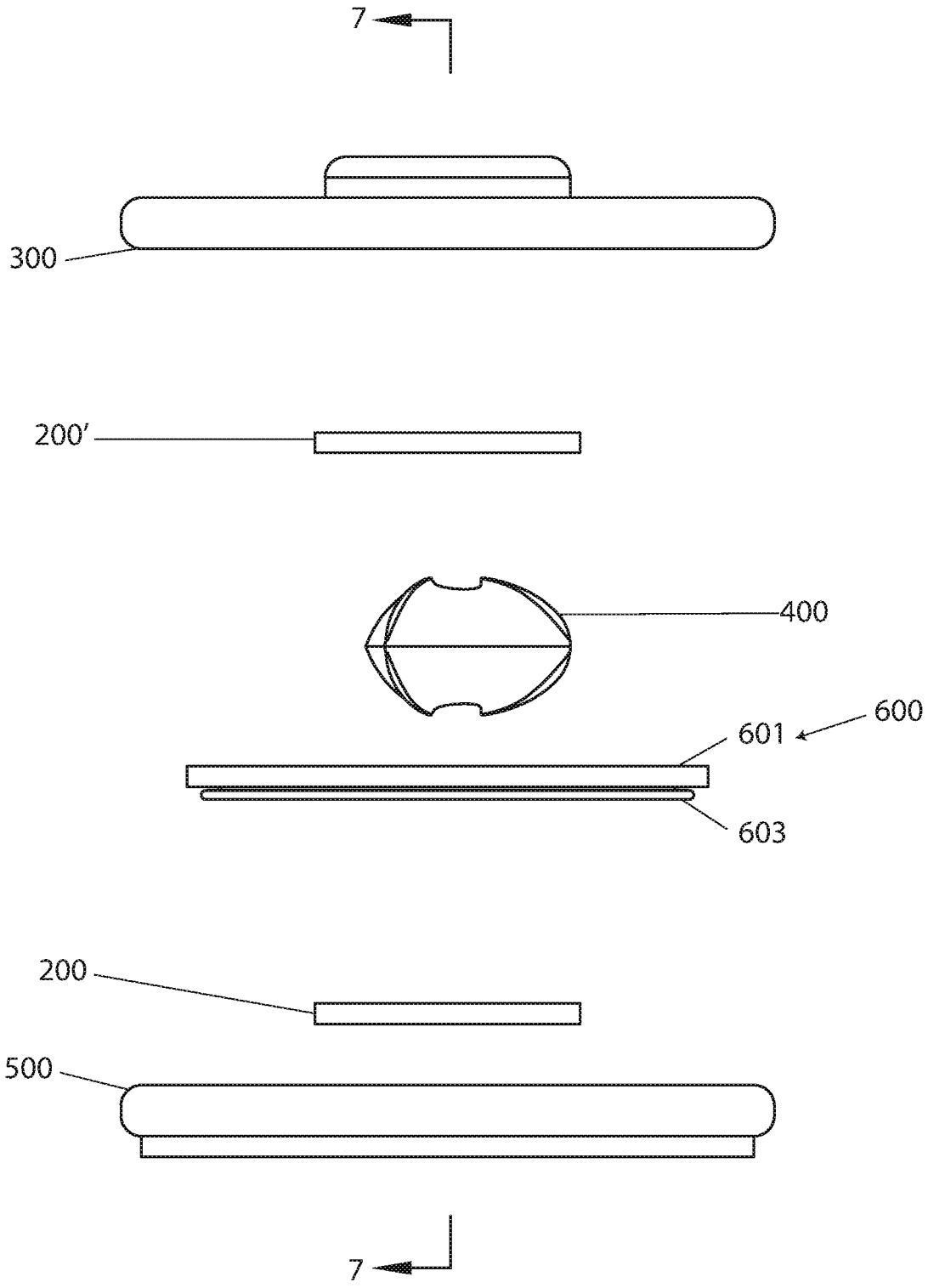
FIG. 6 is front exploded view of the balance board of FIG. 5.
Figure 7:
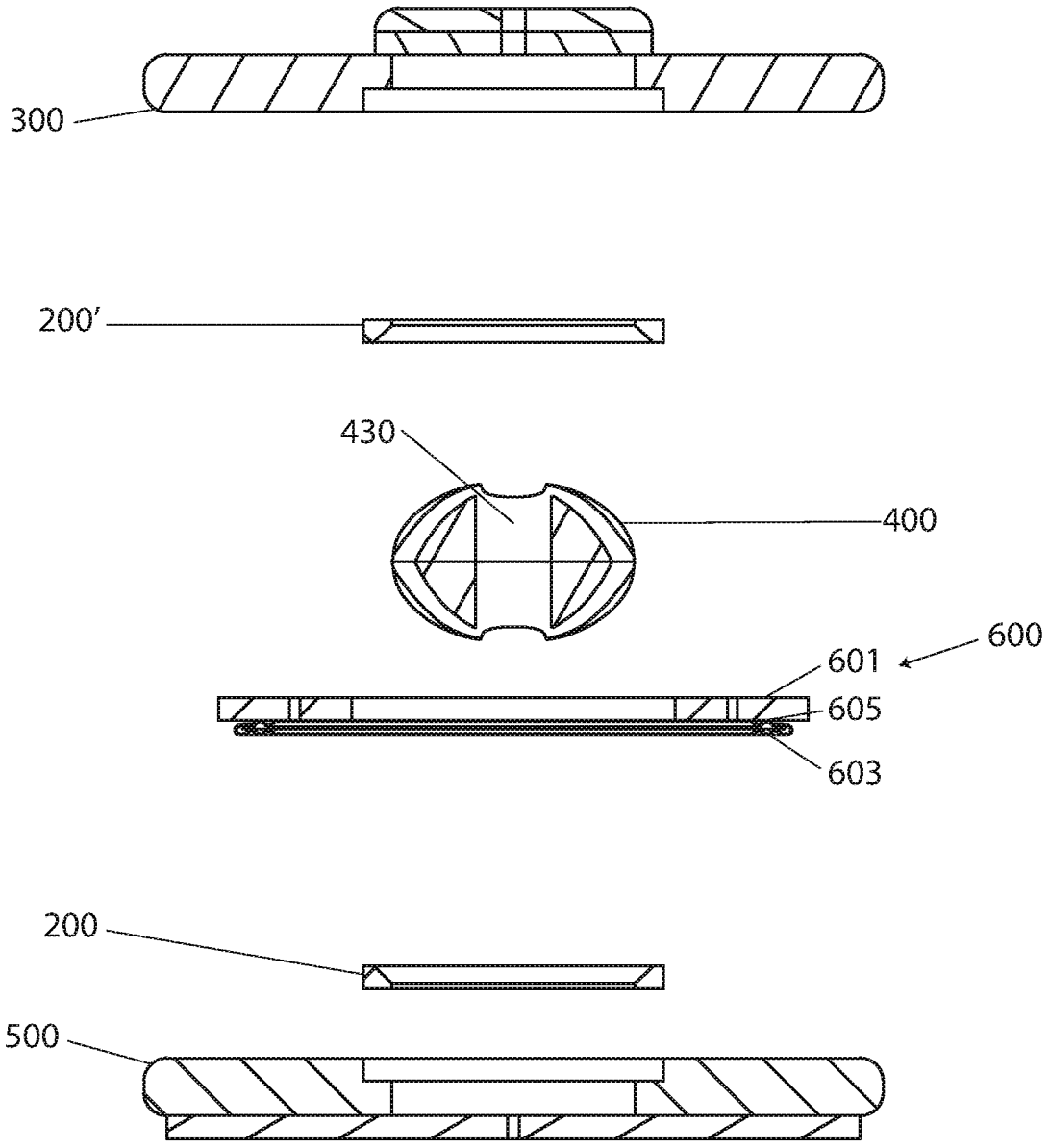
FIG. 7 is a cross-sectional view 7-7 of FIG. 6.

FIG. 5 is an exploded perspective view of the elements of balance board 100 of FIG. 1, without mechanism 700, FIG. 6 is front exploded view of FIG. 5, and FIG. 7 is a cross-sectional view 7-7 of FIG. 6. FIGS. 5-7 show base 500, optional roller bearing assembly 600, a first insert 200, pivot 400, a second insert 200', and platform 300. Inserts 200'/200 are identical in size, shape and dimensions, having an opening with 3-fold symmetry, with first insert 200 and second insert 200' being symmetric about the y-x plane. Inserts 200 and 200' both contact pivot 400 during use of balance board 100. FIGS. 6 and 7 also show that roller bearing assembly 600 includes a top portion 601, a bottom portion 603, and roller bearing 605 between the top and bottom portions of the roller bearing assembly.

Figure 8:
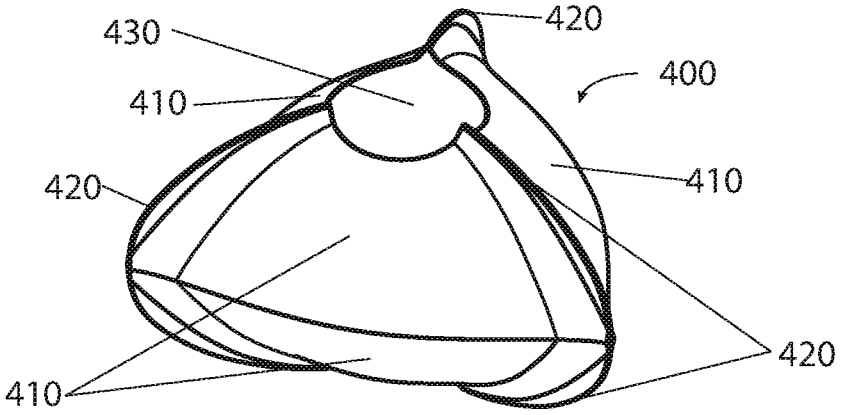
FIG. 8 is a perspective view of one embodiment of the pivot of FIG. 1.
Figure 9:
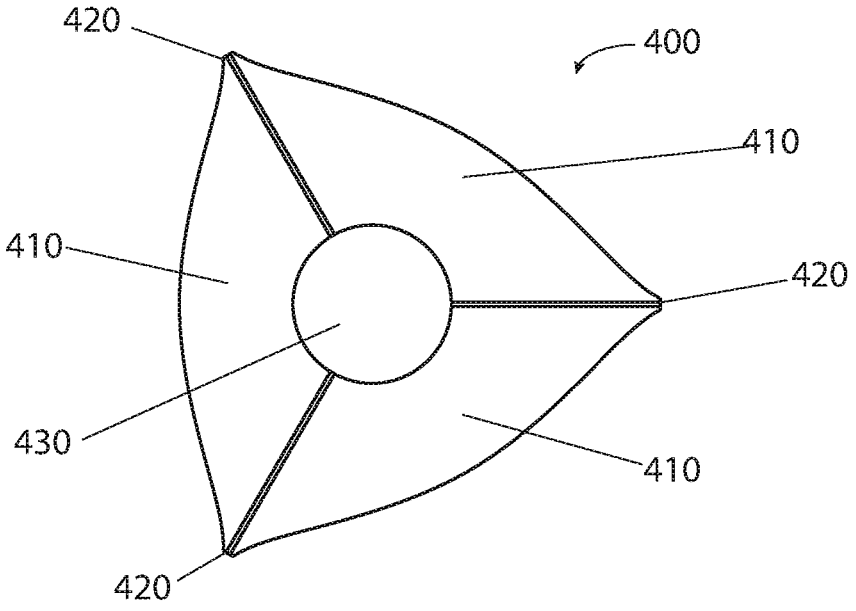
FIG. 9 is a top elevation view of the embodiment of the pivot of FIG. 8.
Figure 10:
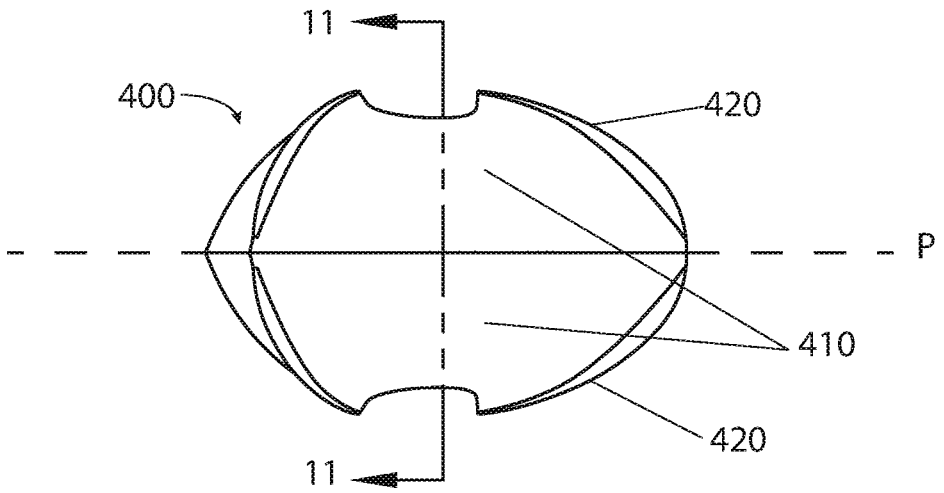
FIG. 10 is a front view of the embodiment of the pivot of FIG. 8.
Figure 11:
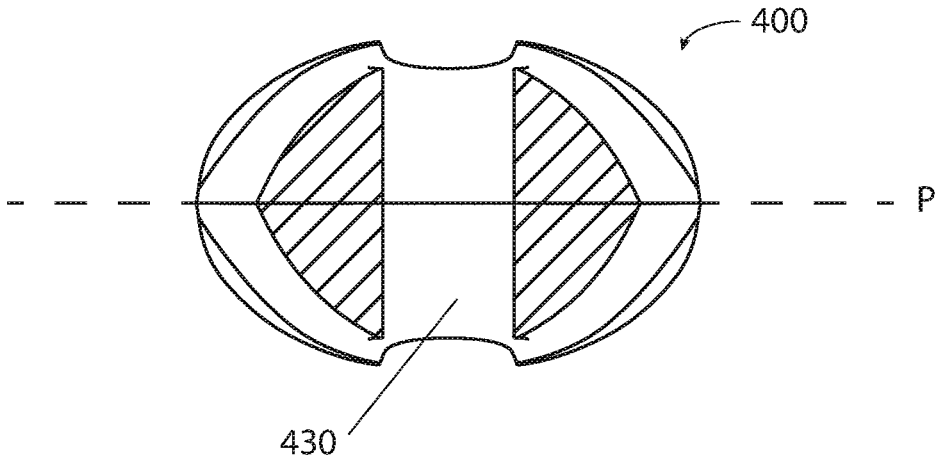
FIG. 11 is a cross-sectional view 11-11 of FIG. 10.

Pivot 400 is shown in greater detail in FIG. 8 as a perspective view of one embodiment of the pivot of balance board 100 of FIG. 1, FIG. 9 is a top elevation view of the pivot of FIG. 8, FIG. 10 is front view of the embodiment of the pivot of FIG. 8, and FIG. 11 is a cross-sectional view 11-11 of FIG. 10.

As shown in FIG. 8, pivot 400 includes surfaces 410 and ridges 420 and a central hole 430. As shown in FIG. 10, pivot 400 has a mid-plane P through the pivot.

The operation of balance board 100 may be understood as follows. Pivot 400 inserts 200 and 200', optional roller bearing assembly 600, and mechanism 700 cooperate to permit rotation of platform 300 about base 500 about the x axis and to provide a restoring force towards a neutral position. FIG. 3 illustrates a spot, S, that is, for illustrative purposes, indicia on top of platform 300, and a neutral axis, N, in the y-z plane, and which is fixed relative to base 500.

When spot S is aligned with neutral axis N, the balance board 100 is in a neutral position. Rotation of spot S away from neutral axis N results in the following actions. The first is the horizontal movement of platform 300 relative to base 500. It will be appreciated that pivot 400 includes curved surfaces which contact inserts 200 and 200'. When platform 300 rotates relative to base 500, the portions of pivot 400 contacting inserts 200 and 200' will change, resulting in a change in the spacing of the inserts, and thus the spacing between platform 300 and base 500, as indicated in FIG. 2 as the spacing $H(\alpha)$. Due to the symmetry and shape of pivot 400 contacting inserts 200 and 200', there will be one orientation of platform 300 and base 500 having a minimum spacing, $H_{min}$. This is referred to herein as the "neutral position," and as having $\alpha=0$. When platform 300 is rotated away from the neutral position ($\alpha\neq0$), inserts 200 and 200' will accommodate pivot 400 by moving away from each other, resulting in a slight increase in H. A second result of the rotation away from the neutral position is that the interaction of the weight of the user and any downwards force from mechanism 700 will result in a restoring force, which will provide a torque on platform 300 towards the neutral position. A third result of the rotation is that the interaction of pivot 400 and inserts 200 and 200' will limit the rotation about the neutral axis, indicated as range a about the neutral axis, as indicted in FIG. 3.

In summary, movement away from the neutral position will: 1) cause platform 300 to move slightly away from base 500; 2) induce a restoring torque on platform 300 towards the neutral position; and 3) limit the amount of rotation due to the shape of pivot 400 and inserts 200 and 200'.

The function of the spring mechanisms described herein are used for adjusting the force between base and platform, or also for adjusting a restoring force to a neutral position for the balance board. It will be appreciated by one skilled in the art that numerous other mechanisms including springs, levers, length adjustments, and the like may be combined to form a mechanism to adjust these forces, and that these are within the scope of the present invention.

Thus, for example, mechanism 700 may affect the movement of platform 300, as follows. First, as noted above when knob 707 is rotated, the tension in spring mechanism 703 increases a compressive force between platform 300 and base 500. This will increase the force between pivot 400 and inserts 200 and 200' and will thus increase the restoring torque in proportion to the increased force. Second, as noted above, platform 300 moves upwards with increasing rotation angle $\alpha$. In addition to increasing the tension in spring mechanism 703, rotation of knob 707 also reduces the length of mechanism 700. Since platform 300 moves away from base 500 during rotation of the platform away from the neutral position, a reduction of the length of mechanism 700 will also reduce the amount of rotation of the platform. Thus, for example, assume that the configuration of pivot 400 and inserts 200 and 200' permits the height H to range from $H_{min}$ (at $\alpha=0$) to a maximum value some value $H_{max}$ at a maximum angle of rotation, $\alpha_{max}$, If turning knob 707 reduces the maximum height of platform 300 above base 500 to a value of $H_{min}$, which is less than $H_{max}$, then the maximum amount of rotation will be less than $\beta_{max}$.

In summary, mechanism 700 may be used to adjust the restoring force towards the neutral position and limit the maximum angle of rotation of platform 300.

Figure 12:
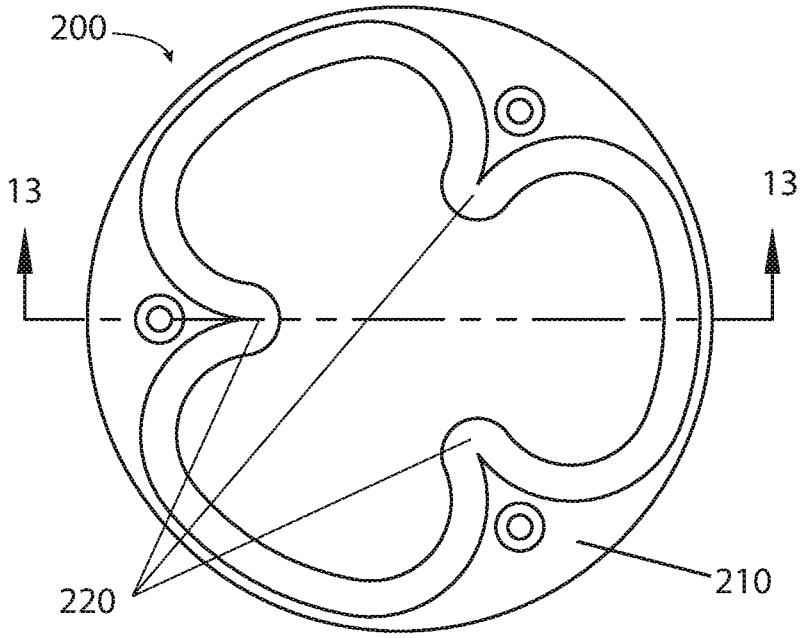
FIG. 12 is a top elevation view of one embodiment of a first insert of the balance board of FIG. 1.
Figure 13:
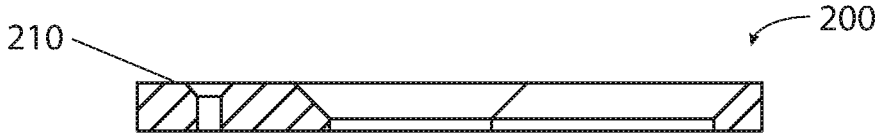
FIG. 13 is a front cross-sectional view 13-13 of the embodiment of the insert of FIG. 12.
Figure 14:
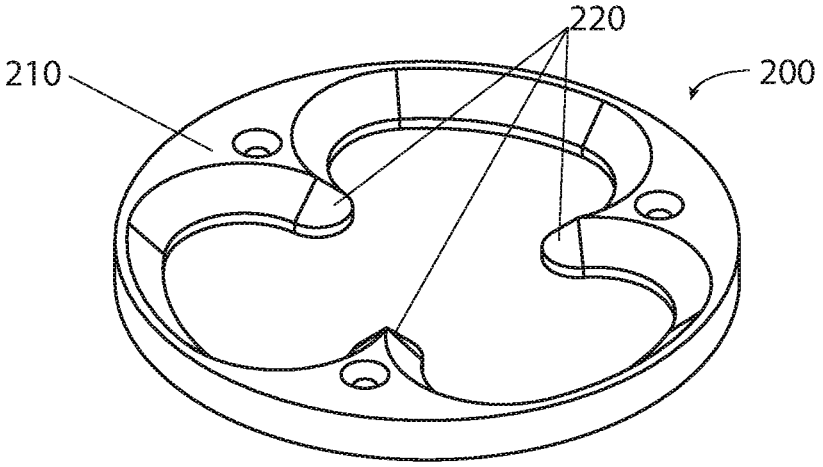
FIG. 14 is a top perspective view of the embodiment of the insert of FIG. 12

FIG. 12 is a top elevation view of one embodiment of first insert 200, FIG. 13 is a front cross-sectional view 13-13 of the first insert 200 of FIG. 12, and FIG. 14 is a top perspective view first insert 200 of FIG. 12. First insert 200 includes a surface 210 which faces pivot 400 when assembled and contacting pivot 400 at surfaces 220.

Figure 15:
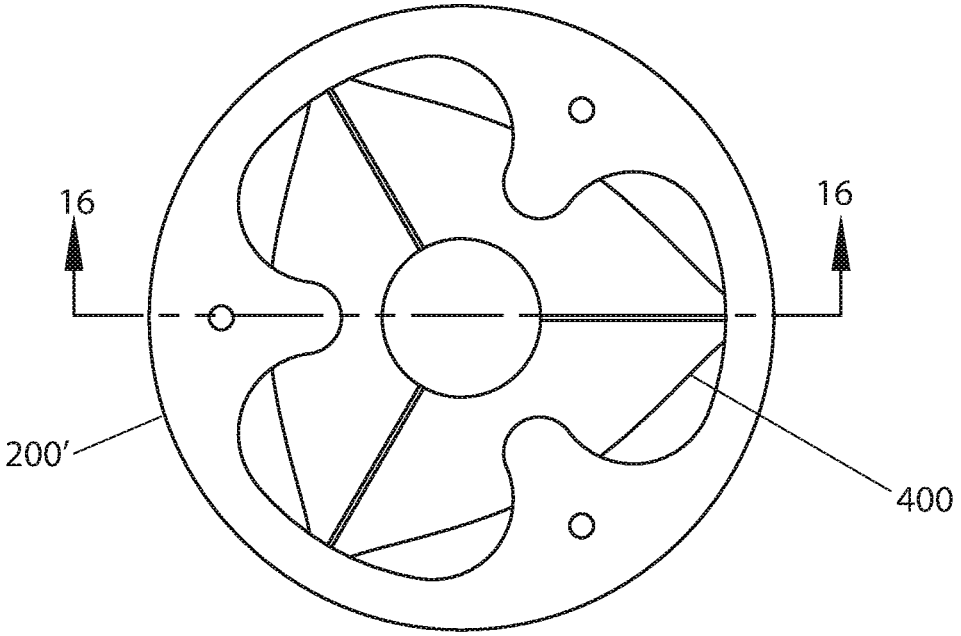
FIG. 15 is a top elevation view of the first and second inserts and pivot.
Figure 16:
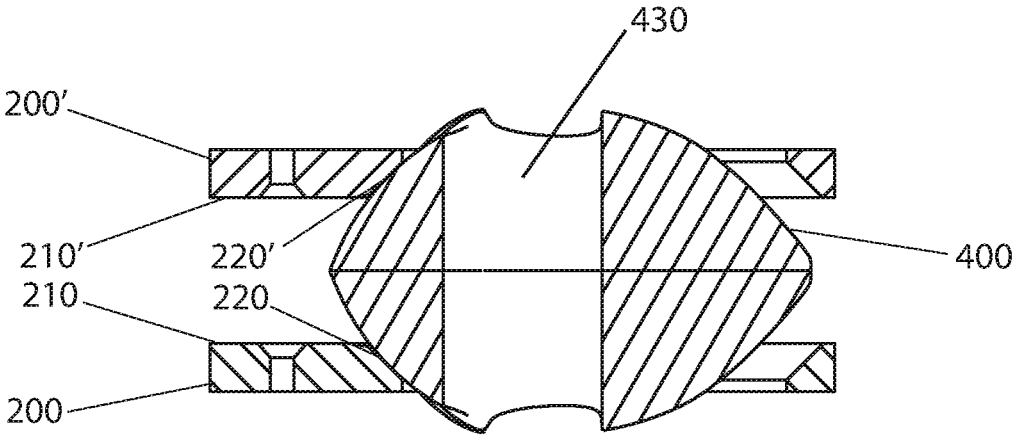
FIG. 16 is a front cross-sectional view 16-16 of FIG. 15.

FIG. 15 is a top elevation view of inserts 200 and 200' and pivot 400, and FIG. 16 is a front cross-sectional view 16-16 of FIG. 15 showing insert 200' from platform 300 with surface 210' facing pivot 400 and surfaces 220' contacting pivot 400, and insert 200 from base 500 with surface 210 facing pivot 400 and surfaces 220 contacting pivot 400.

Figure 17:
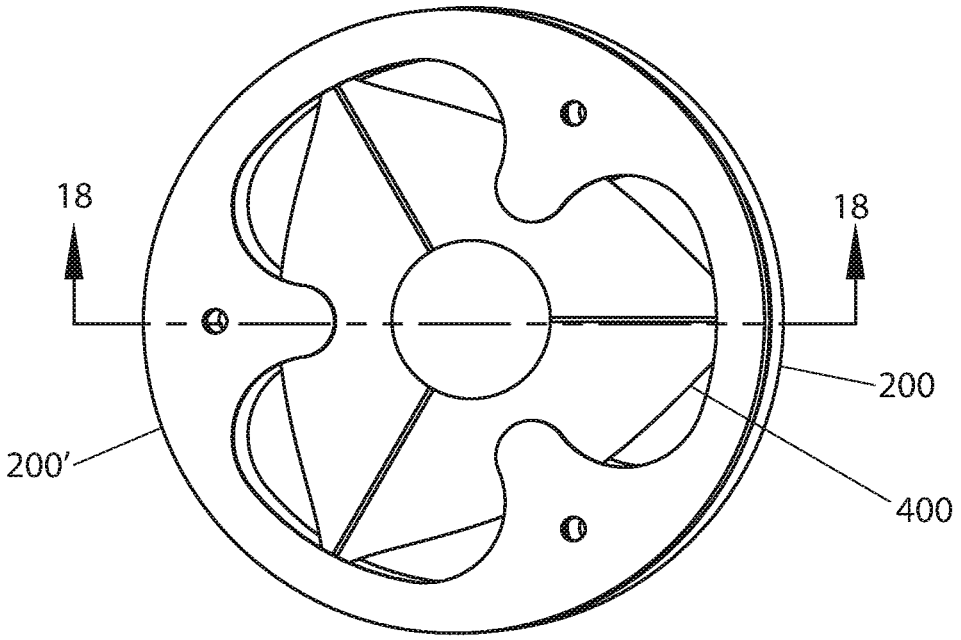
FIG. 17 is top elevation view of the insert of FIG. 15.
Figure 18:
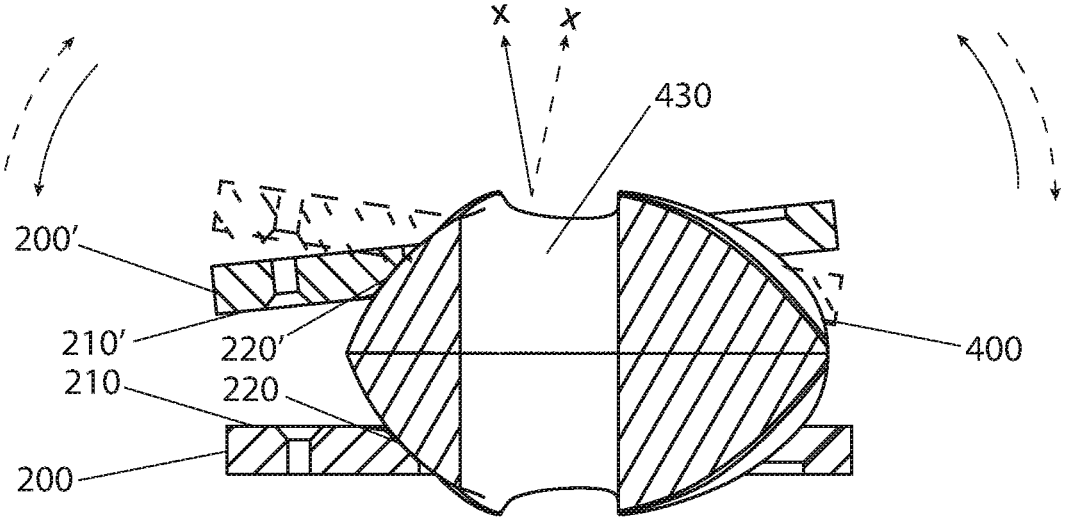
FIG. 18 is a front cross-sectional view 18-18 of FIG. 17.

FIG. 17 is top elevation view of second insert 200' tilted in the y and z-axis, and pivot 400. FIG. 18 is a front cross-sectional view 18-18 of FIG. 17. FIGS. 17 and 18 show insert 200' from platform 300 tilted with surface 210' facing pivot 400 and surfaces 220' contacting pivot 400 and insert 200 from base 500 with surface 210 facing pivot 400 and surfaces 220 contacting pivot 400.

Figure 19:
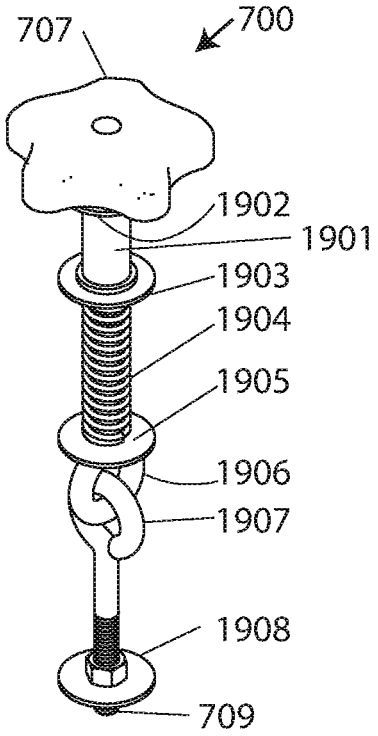
FIG. 19 is a top perspective view of a first embodiment spring mechanism.
Figure 20:
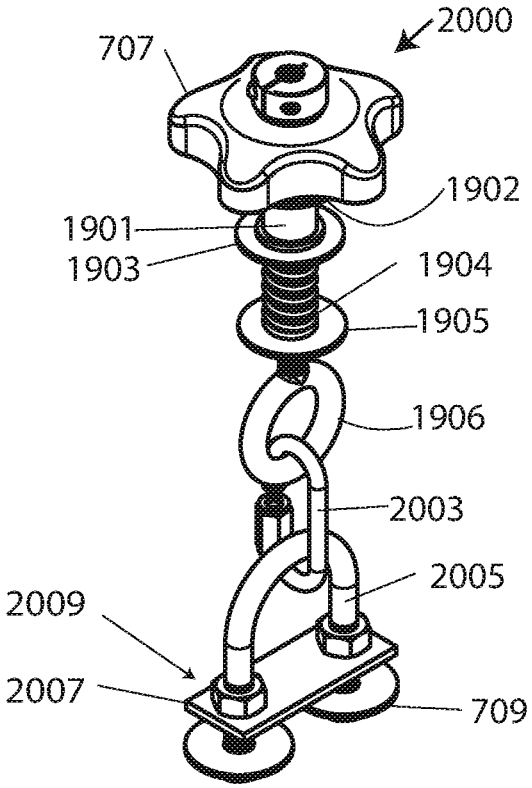
FIG. 20 is a top perspective view of a second embodiment spring mechanism.
Figure 21:
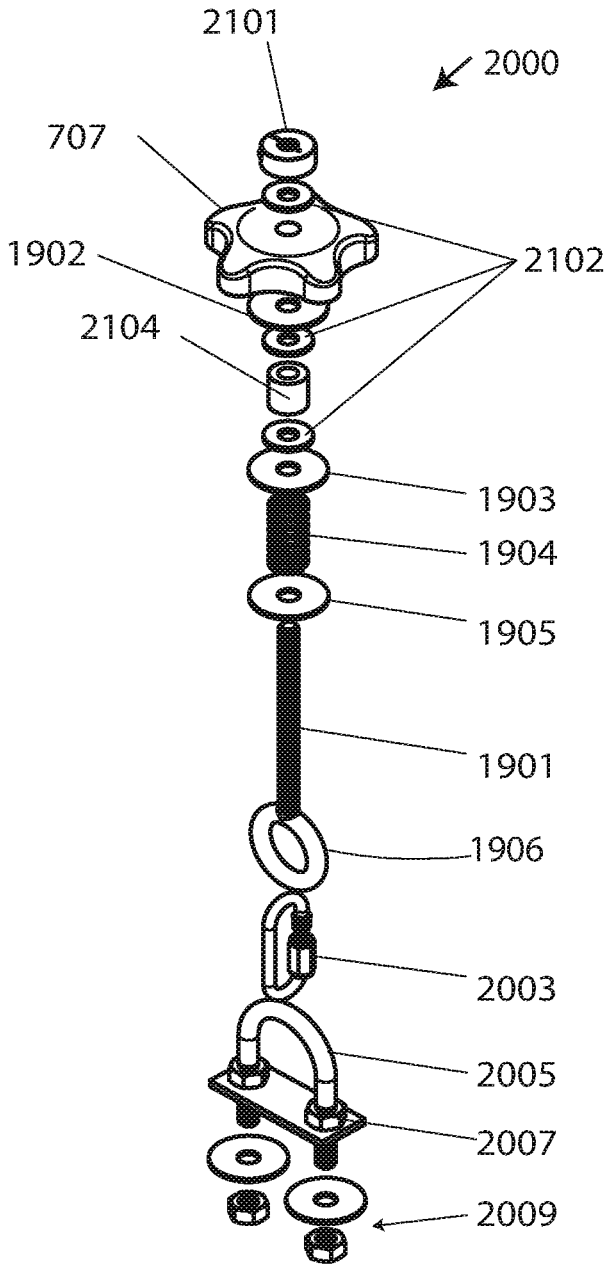
FIG. 21 is an explode view of the spring mechanism of FIG. 20.

FIG. 19 is a perspective view of mechanism 700, which includes an adjustable length rod 1901 that extends from knob 707 to an eye 1906, pair of flanges 1902 and 1903, a spring 1904, a bottom flange or washer 1905 and an eyebolt 1907 that is threaded onto nut/washer combination 1908 near threaded end 709. The pair of flanges 1902 and 1903 are positioned on opposing portions of top portion 701 near aperture 702 to anchor the top portion of mechanism 700. Washers 1903 and 1905 constrain the ends of spring 1904 such that the spring force is transferred to those washers. Rod 1901 includes two threaded components (not shown) that change the distance between washers 1903 and 1905 when knob 707 is rotated. Rotating knob 707 thus adjusts a compressive force between platform 300 and base 500. This force acts as force on balance board 100 that is in addition to the weight of user U, and thus affects the rotational forces, as described above. In addition, when washers 1903 and 1905 move towards one another, the maximum angle of rotation of platform 300 relative to base 500 is limited, as discussed above FIG. 20 is a top perspective view of mechanism 2000 showing an alternative hardware configuration, and FIG. 21 is an exploded view of the spring mechanism of FIG. 20. Mechanism 2000 is generally similar to mechanism 700, except as explicitly stated.

Mechanism 2000 includes threaded shaft collar 2101 that accepts the threaded end of rod 1902, polytetrafluoroethylene washers 2102, and a spacer 2104. Eye 1906 is attached to a linkage 2003, which is connected to a U-bolt 2005 that is held in place on base 500 by a plate 2007 and a pair of washers and nuts 2009. With the rotation of eye 1906 limited by linkage 2003, tightening knob 707 results in a reduction of the spacing of washers 1903 and 1905, which limits the upwards motion of the platform and thus the amount of board rotation, and a compression of spring 1904 which increases the restoring force or torque towards the neutral position.

In operation one uses balance board 100 by standing on platform 300 to perform a variety of exercises that trains balance, timing and rhythm while building core strength with respect to body rotation. The adjustment knob 707 allows the user to vary the force between base 500 and platform 300, which in turn affects the torque on platform when the user rotates the platform. In addition, depending on the design of pivot, the maximum height of platform 300 above base 500 is limited according to the shapes of pivot 400 and inserts 200 and 200' and length of mechanism 700 or 2000, affecting the rotational angle around the x-axis so that user U can perform exercises at a varying degree of rotation and tempo.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment. Furthermore, the particular features, structures or characteristics may be combined in any suitable manner, as would be apparent to one of ordinary skill in the art from this disclosure, in one or more embodiments. Thus, for example, a balance board within the scope of this patent may have any of the aspects of the mechanism connecting board and base described herein. Thus, for example and without limitation, the various embodiments of pivots, boards, bases, and spring mechanisms described herein may be combined to form one of numerous balance board embodiments, and any of the pivots attached to the board may include a smooth distal end to permit using the board without the base.

Similarly, it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Thus, while there has been described what is believed to be the preferred embodiments of the invention, those skilled in the art will recognize that other and further modifications may be made thereto without departing from the spirit of the invention, and it is intended to claim all such changes and modifications as fall within the scope of the invention. Thus, for example, only certain portions of the pivot may exhibit the described degrees of rotational symmetry.

I claim:

1. An exercise apparatus for a user, said exercise apparatus comprising:

a base for placing on the ground, where the base has a base axis that is perpendicular to the ground;

a board including a platform to accept a body part of the user, where the board has a board axis that is perpendicular to the platform, and where said board has a neutral position relative to said base;

a mechanism to provide a user-selected force on said board towards said neutral position, such that, when said board is rotated about said board axis and away from said neutral position, said mechanism imparts a force on said board towards said neutral position, where said mechanism includes:

a pivot disposed between said base and said board, and an assembly connected to said base and said board, where said assembly includes a spring to provide the user-adjustable force, where said user-adjustable force and said pivot cooperate to provide said force on said board towards said neutral position, where said pivot has a pivot axis, where said base includes a support configured to slidably contact a surface of said pivot, where said base includes three supports equally spaced about said base axis, where said board includes three supports equally spaced about said board axis, and where at least part of said pivot has three-fold symmetry about said pivot axis.

2. The exercise apparatus of claim 1, where said pivot is not directly attached to either said base or said platform.

3. The exercise apparatus of claim 1, where said support includes three supports equally spaced about said base axis.

4. The exercise apparatus of claim 1, where said pivot includes an aperture, and where said assembly is attached to said base and said board through said aperture.

5. The exercise apparatus of claim 1, said exercise device further comprising a second mechanism to limit a maximum rotation of said board away from said neutral position.

6. An exercise apparatus for a user, said exercise apparatus comprising:

abase for placing on the ground, where the base has a base axis that is perpendicular to the ground, a board including a platform to accept a body part of the user, where the board has a board axis that is perpendicular to the platform, and where said board has a neutral position relative to said base, where, when said board is rotated about said board axis and away from said neutral position, said exercise device imparts a force on said board towards said neutral position; and a mechanism to provide a user-selected limit on a maximum rotation of said board away from said neutral position, where, when said board is rotated about said board axis and away from said neutral position, said mechanism imparts a force on said board towards said neutral position, where said mechanism includes:

a pivot disposed between said base and said board, where said pivot, said board, and said base cooperate to move said board away from said base when said board is rotated about said board axis and away from said neutral position; and an assembly connected to said base and said board, where said assembly adjusts a maximum displacement of said board away from said base when said board is rotated about said board axis, thus limiting the maximum rotation of said board away from said neutral position, where said pivot is not directly attached to either said base or said platform, where said pivot has a pivot axis, where said base includes a support configured to slidably contact a surface of said pivot, where said base includes three supports equally spaced about said base axis, where said board includes three supports equally spaced about said board axis, and where at least part of said pivot has three-fold symmetry about said pivot axis.

7. The exercise apparatus of claim 6, where said support includes three supports equally spaced about said base axis.

8. The exercise apparatus of claim 6, where said pivot includes an aperture, and where said assembly is attached to said base and said board through said aperture.

9. The exercise apparatus of claim 6, said exercise device further comprising a mechanism to provide a user-selected force on said base towards said neutral position.

10. An exercise apparatus for a user, said exercise apparatus comprising, a base for placing on the ground, where the base has a base axis that is perpendicular to the ground;

a board including a platform to accept a body part of the user, where the board has a board axis that is perpendicular to the platform, and where said board has a neutral position relative to said base;

a pivot disposed between said base and said board, where said pivot, said board, and said base cooperate to move said board away from said base when said board is rotated about said board axis and away from said neutral position and to provide a force on said base towards said neutral position, and an assembly connected to said base and said board, where said assembly is user-adjustable to: 1) limit a maximum displacement of said board away from said base when said board is rotated about said board axis, thus limiting the maximum rotation of said board away from said neutral position, and 2) adjust an additional force on said base towards said neutral position, such that, when said board is rotated about said board axis and away from neutral position, said mechanism imparts a force on said board towards said neutral position, where said pivot has a pivot axis, where said base includes a support configured to slidably contact a surface of said pivot, where said base includes three supports equally spaced about said base axis, where said board includes three supports equally spaced about said board axis, and where at least part of said pivot has three-fold symmetry about said pivot axis.

11. The exercise apparatus of claim 10, where said pivot includes an aperture, and where said assembly is attached to said base and said board through said aperture.

* * * * *